United States Patent [19]

Farrell

[11] 4,084,349

[45] Apr. 18, 1978

[54] SHAPE GRINDER AND METHOD

[75] Inventor: John H. Farrell, Buffalo, N.Y.

[73] Assignee: Houdaille Industries, Inc., Buffalo, N.Y.

[21] Appl. No.: 707,947

[22] Filed: Jul. 23, 1976

[51] Int. Cl.[2] ..... B24B 7/02; B24B 1/00

[52] U.S. Cl. ..... 51/5 D; 51/93; 51/165.71; 51/327

[58] Field of Search ..... 51/5 D, 92 R, 92 ND, 51/93, 95 R, 98.5, 97 NC, 165.71, 165.76, 216 ND, 231, 327; 90/21 D

[56] References Cited

U.S. PATENT DOCUMENTS

| | | | |
|---|---|---|---|
| 1,211,381 | 1/1917 | Alden | 51/93 X |
| 3,407,540 | 10/1968 | Browder | 51/92 R |
| 3,651,603 | 3/1972 | Patch | 51/97 NC X |
| 3,688,451 | 9/1972 | Schnellman | 51/216 ND |
| 3,797,173 | 3/1974 | Pettee | 51/98.5 X |
| 4,025,764 | 5/1977 | Tack | 51/165.71 X |

*Primary Examiner*—Gary L. Smith

*Attorney, Agent, or Firm*—Hill, Gross, Simpson, Van Santen, Steadman, Chiara & Simpson

[57] ABSTRACT

Grinding apparatus for forming noncircular punching tools comprising a grinding wheel having a cylindrical grinding surface, a rotary table with its axis parallel to the grinding wheel axis and carrying orthogonally movable slides such that one slide at a time may be actuated to generate successive flat sides of a punching tool, the table axis being positionable to define a center of rotation for an arcuate face of the punching tool which is generated upon rotation of the table, and a fixture for the grinding wheel dressing tool serving to automatically define the location of the grinding wheel surface relative to the axis of the rotary table.

6 Claims, 13 Drawing Figures

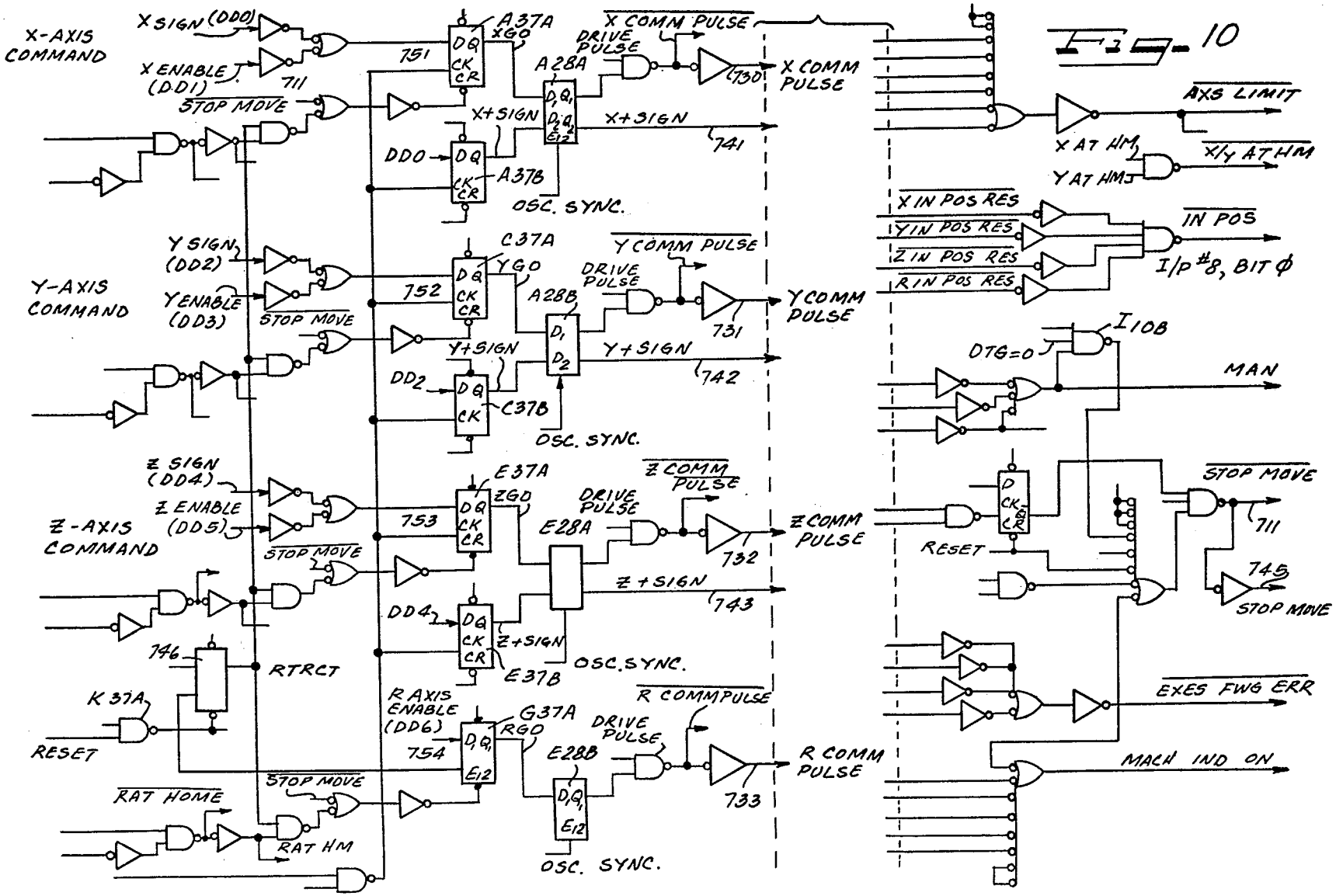
Fig. 10
AXIS LIMIT
X AT HM
X/Y AT HM
IN POS
I/P #8, BIT Ø
X IN POS RES
Y IN POS RES
Z IN POS RES
R IN POS RES
I10B
DTG=0
MAN
STOP MOVE
711
745
STOP MOVE
RESET
EXES FWD ERR
MACH IND ON
X COMM PULSE
Y COMM PULSE
Z COMM PULSE
R COMM PULSE
X COMM PULSE
DRIVE PULSE
730
741
X+SIGN
A28A
A37A
XGO
A37B
OSC. SYNC.
751
DDO
Y COMM PULSE
731
742
Y+SIGN
A28B
C37A
YGO
C37B
752
DD2
Z COMM PULSE
732
743
Z+SIGN
E28A
E37A
ZGO
E37B
753
DD4
R COMM PULSE
733
E28B
G37A
RGO
R AXIS ENABLE (DD6)
754
X SIGN (DDO)
X ENABLE (DD1)
STOP MOVE
Y SIGN (DD2)
Y ENABLE (DD3)
Z SIGN (DD4)
Z ENABLE (DD5)
RTRCT
746
K 37A
RESET
RAT HOME
RAT HM
X-AXIS COMMAND
Y-AXIS COMMAND
Z-AXIS COMMAND

SHAPE GRINDER AND METHOD

SUMMARY OF THE INVENTION

This invention relates to a machine tool apparatus and method, and particularly to a grinding machine for the production of noncircular punching tools such as have heretofore been produced by means of specially manufactured control cams.

It is an important object of the present invention to provide a simplified and highly adaptable machine tool apparatus and method for forming noncircular punching tools and the like.

Another object of the invention is to provide a grinding apparatus and method for forming noncircular punching tools which is adapted for digital control and which is operable by means of a sequential activation of individual axes of movement for improved accuracy and ease of programming.

A further important object of the invention is to provide a grinding apparatus and method which greatly facilitates the set up of the tool blank at a predetermined distance from the grinding wheel face.

It is a feature of the invention to provide a work forming system and method wherein a radially symmetrical rotary cutter acts on the work piece at the same side of the cutter periphery throughout the formation of a workpiece into a desired noncircular configuration.

Another feature of the invention resides in the provision of a grinding system and method wherein the grinding wheel axis is stationary during forming of generally obround, square and rectangular shapes, the workpiece being moved substantially continuously in a path such that the perimeter of the workpiece maintains a substantially continuous pressure engagement at a given point about the periphery of the grinding wheel as successive cuts are made in a given direction about the perimeter of the workpiece.

Other objects, features and advantages of the present invention will be apparent from the following detailed description, given by way of preferred example and not by way of limitation.

BRIEF DESCRIPTION OF THE DRAWINGS

FIG. 10 is a detailed electric circuit diagram of the Steering Circuitry component of FIG. 9;

DETAILED DESCRIPTION OF THE PREFERRED EMBODIMENT

Figure 1:
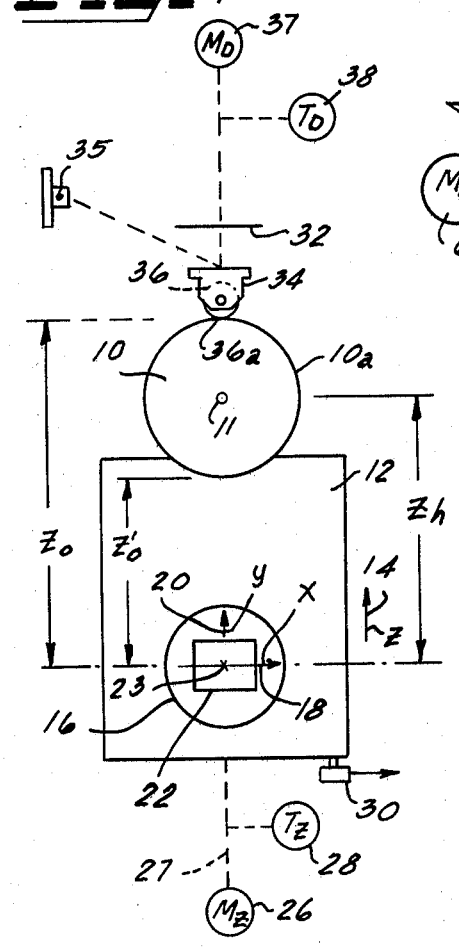
FIG. 1 is a diagrammatic plan view of a grinding apparatus in accordance with the present invention and illustrating the condition of the apparatus during initiation of a grinding wheel dressing operation for a new grinding wheel.

Referring to FIG. 1, there is illustrated a grinding wheel 10 having a cylindrical peripheral surface 10*a* and rotatable on a central axis indicated at 11. Associated with the grinding wheel is a slide 12 reciprocally movable along a Z axis such as indicated by arrow 14 toward and away from the grinding wheel 10. The slide 12 carries a rotary table 16 rotatable on a central axis and carrying slides movable along X and Y axes as indicated by arrows 18 and 20. A tool blank is indicated at 22 having a central tool axis 23 coincident with the axis of rotation of table 16. By way of example, tool blank 22 may be fixed to the X slide, and the X slide may be carried by a Y slide which in turn is mounted on the rotary table 16. A drive for the slide 12 is diagrammatically indicated at 26 having a mechanical coupling as indicated at 27 with the slide 12, and the coupling 27 being shown as also driving a position transducer device such as a rotary encoder 28. A limit switch is indicated at 30 for actuation when the slide 12 reaches a zero position.

For the sake of a diagrammatic illustration, reference numeral 32 indicates a mechanical gage and reference numeral 34 indicates a portion of a slide assembly for mounting a rotary diamond roll dresser 36. The slide assembly 34 may be moved from engagement with gage 32 to an initial position at a predetermined distance from gauge 32 by means of a handwheel 35. For example, the handwheel 35 may have an associated dial calibrated in thousandths of an inch between 0 and 100 mils, and may be set to a predetermined number in preparation for an automatic new wheel dressing cycle so as to bring the face 36*a* of the rotary diamond roll dresser 36 to an accurate distance from the gauge 32. At that time, the distance between point 23 which is coincident with the center of rotation of table 16 and the central axis of the tool blank 22, and face 36*a* of the dresser 36 will be known. The dresser 36 can then be automatically fed by means of drive 37 to a position for dressing wheel 10 to a desired initial diameter, transducer 38 or the equivalent keeping track of the dresser position.

With the arrangement of FIG. 1, after dressing of the surface 10*a* of grinding wheel 10, the dressed grinding wheel surface will be precisely a distance $Z_0$ from point 23. If a Z axis counter (not shown) is set to zero at the completion of a dressing operation, then a program written on the basis of an initial distance of $Z_0$ between point 23 and the surface of grinding wheel 10 will be immediately operative. Otherwise a suitable grinding wheel offset value can be introduced into the initial position of the Z slide 12.

Figure 2:
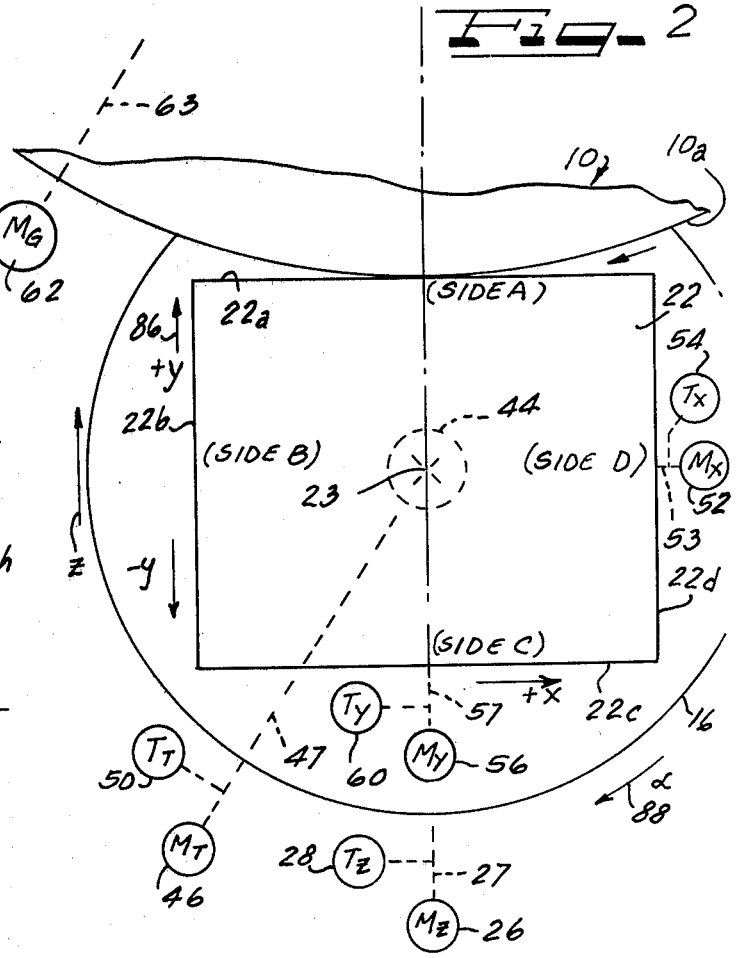
FIG. 2 is an enlarged diagrammatic view showing the apparatus of FIG. 1 in position to begin a grinding operation.

Referring to FIG. 2, rotary table 16 is diagrammatically indicated as having a central shaft 44 which is rotatably driven by means of a table drive 46 via a mechanical coupling indicated at 47. A position transducer such as a digital encoder is indicated at 50 and is shown as being mechanically coupled with the coupling 47. A drive for the X slide is indicated at 52 and includes a mechanical coupling 53 to the X slide and to a position transducer such as a digital encoder 54. A drive for the Y slide is indicated at 56 and is indicated as having a mechanical coupling 57 which is also in driving relation to a position transducer such as a digital encoder 60.

As indicated in FIG. 2, grinding wheel 10 may be provided with an adjustable speed drive 62 having a mechanical coupling 63 with the central shaft of the grinding wheel. It is contemplated that the surface speed of the grinding wheel 10 may be maintained at a precise optimum speed by adjusting the speed of drive 62 as the radius of the grinding wheel changes.

It will be noted that with the slide 12 in the home position where microswitch 30 is actuated as shown in FIG. 1, the distance $Z_h$ between the axis of the grinding wheel (indicated at 11 in FIG. 1), and the axis of the rotatable table 16 (as indicated at 23) will be known. By thereafter keeping a count of the output from the transducers and by keeping track of adjustments of the dressing tool 36, the distance between the center of the tool blank 22 and the dressed surface 10*a* of the grinding wheel will be known at all times. If, then, it is desired to move the tool blank 22 from the position shown in FIG. 1 to the position shown in FIG. 2, a suitable count value could be entered into a Z command register and the drive 26 could be energized under the control of a suitable comparator circuit. When the Z position counter connected to Z position encoder 28 registered a count value corresponding to the commanded count value in the command register, the comparator circuitry would cause the drive component 26 to be deenergized, with rotary table 16 and tool blank 22 positioned as indicated in FIG. 2.

If, for example, it were desired to make an initial cut of five mils about the perimeter of the blank 22, and at the same time to form rounded corners with a radius of curvature of 2 mils, then the axis of rotation of table 16 would be placed at a distance of seven mils from edge 22*a* of blank 22. For the purpose of a preliminary example, the dimensions indicated in FIG. 3 for the blank 22 may be converted to units of mils 1 mil equals 0.001 inch). Accordingly sides 22*b* and 22*d* could be 1.250 mils, while sides 22*a* and 22*c* might be 1,500 mils. With this specific example, one-half the width of blank 22 would be 625 mils, and blank 22 might be retracted by means of the Y-axis slide in the minus Y direction 618 mils, and then the Z slide 12 advanced 623 mils. The final Z axis value would then be $Z = 14.998$ where a distance $Z_0'$ of 15 inches initially existed between the center of the blank 22 and the surface 10*a* in FIG. 1. The grinding wheel 10 would be in grinding contact with the surface 22*a* at side A of the blank 22 during the last 5 mils of movement of the Z axis slide.

With the Z axis slide 12 fixed at a position $Z = 14.998$, the X slide could be activated to shift the blank 22 to the right for progressively removing 5 mils of material along the left half of side A. Where one-half of the length of the side A is equal to 750 mils, the X slide might be moved 743 mils, whereupon the drive 46 would be activated to rotate table 16 through 90°. For the sake of a diagrammatic indication, referring to FIG. 3, the axis of the rotary table 16 would be located as indicated at 44*a* during the time that the rotary table was being rotated through 90°, the point 44*a* being 7 mils from the initial side face 22*a* and from the adjacent side face 22*b*. Of course, the distance of point 44*a* from sides 22*a* and 22*b* is greatly exaggerated for the purpose of clearer illustration. In order to assist in visualizing the operation so far, a dot dash line is indicated at 84 in FIG. 3 which would indicate the outline of the blank 12 after the rotary table 16 has completed a rotation 90°. The arcuate dot dash line at 84*a* would represent the arcuate face of the blank as produced during the rotation of the table 16, while the curvature indicated at 84*b* is intended to diagrammatically indicate the curvature of the grinding wheel, so as to indicate the appearance of side B of the blank immediately at the completion of the rotation of the table 16 through 90°. For the specific example given, the arcuate portion 84*a* would have a radius of 2 mils and a center at the point 44*a*.

Since the X and Y slides rotate with the table 16, it can be visualized that the Y axis slide should now be moved in the direction of arrow 86, FIG. 2 (after rotation through an angle $\alpha$ as indicated by arrow 88 in FIG. 2 of 90°. If the initial dimension of side 22*b* is 1,250 mils, the Y move should be 14 mils less or 1,236 mils.

Figure 3:
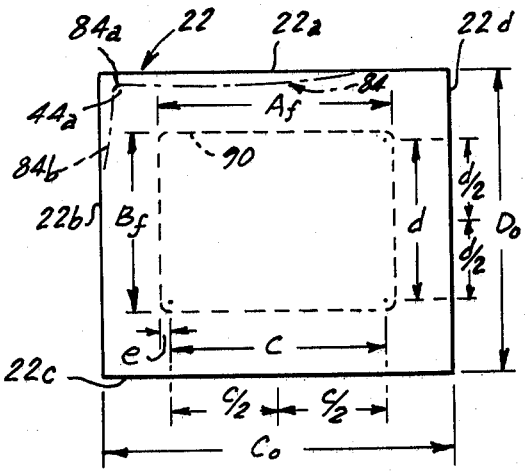
FIG. 3 is a diagrammatic plan view indicating the initial cross-sectional configuration of a tool blank, and indicating an exemplary desired final configuration to be formed from the blank.

The table I on the following pages will serve to illustrate or tabulate the successive moves which might be effected automatically or by manual entry of successive axis count commands so as to produce a finished cross-section configuration for the tool such as indicated at 90 in FIG. 3.

TABLE I

| Side | X Move (Mils) | Y Move (Mils) | Z Move (Mils) | Minimum Depth of Cut(Mils) | Table Rotation (Degrees) | Maximum Depth of Cut(at corner) | Final Position of center of Rotary table($Z_O'$=15") |
|---|---|---|---|---|---|---|---|
| | | −618 | | | | | 14.375 |
| A1 | | | 623 | 5 | | | 14.998 |
| A1 | 743 | | | 5 | 90 | 7.898 | |
| B1 | | 1236 | | 5 | 90 | 7.898 | |
| C1 | −1486 | | | 5 | 90 | 7.898 | |
| D1 | | −1236 | | 5 | 90 | 7.898 | |
| A1 | 743 | | | 5 | | | |
| | | | −1 | | | | 14.997 |
| A2 | | 6 | | 5 | | | |
| A2 | 737 | | | 5 | 90 | 7.484 | |
| B2 | | 1224 | | 5 | 90 | 7.484 | |
| C2 | −1474 | | | 5 | 90 | 7.484 | |
| D2 | | −1224 | | 5 | 90 | 7.484 | |
| A2 | 737 | | | 5 | | | |
| | | | −1 | | | | 14.996 |
| A3 | | 6 | | 5 | | | |
| A3 | 731 | | | 5 | 90 | 7.484 | |

TABLE I-continued

| Side | X Move (Mils) | Y Move (Mils) | Z Move (Mils) | Minimum Depth of Cut(Mils) | Table Rotation (Degrees) | Maximum Depth of Cut(at corner) | Final Position of center of Rotary table($Z_O'=15''$) |
|---|---|---|---|---|---|---|---|
| B3 | | 1212 | | 5 | 90 | 7.484 | |
| C3 | −1462 | | | 5 | 90 | 7.484 | |
| D3 | | −1212 | | 5 | 90 | 7.484 | |
| A3 | 731 | | | 5 | | | |
| | | | 0 | | | | 14.996 |
| A4 | | 5 | | 5 | | | |
| | | | −1 | | | | 14.952 |
| A48 | | 6 | | 5 | | | |
| A48 | 467 | | | 5 | 90 | 7.484 | |
| B48 | | 684 | | 5 | 90 | 7.484 | |
| C48 | −934 | | | 5 | 90 | 7.484 | |
| D48 | | −684 | | 5 | 90 | 7.484 | |
| A48 | 467 | | | 5 | | | |
| | | | −1 | | | | 14.951 |
| A49 | | 6 | | 5 | | | |
| A49 | 461 | | | 5 | 90 | 7.484 | |
| B49 | | 672 | | 5 | 90 | 7.484 | |
| C49 | −922 | | | 5 | 90 | 7.484 | |
| D49 | | −672 | | 5 | 90 | 7.484 | |
| A49 | 461 | | | 5 | | | |
| | | | −1 | | | | 14.950 |
| A49 | | 4 | | 3 | | | |
| A49 | 452 | | | 3 | 90 | 7.484 | |
| B49 | | 654 | | 3 | 90 | 7.484 | |
| C49 | −904 | | | 3 | 90 | 7.484 | |
| D49 | | −654 | | 3 | 90 | 7.484 | |
| A49 | 452 | | | 3 | | | |
| A50 | | | | | | | 14.950 |
| A50 | | 3 | | 3 | | | |

Description of the Grinding Machine of FIGS. 4–7

Figures 4, 6:
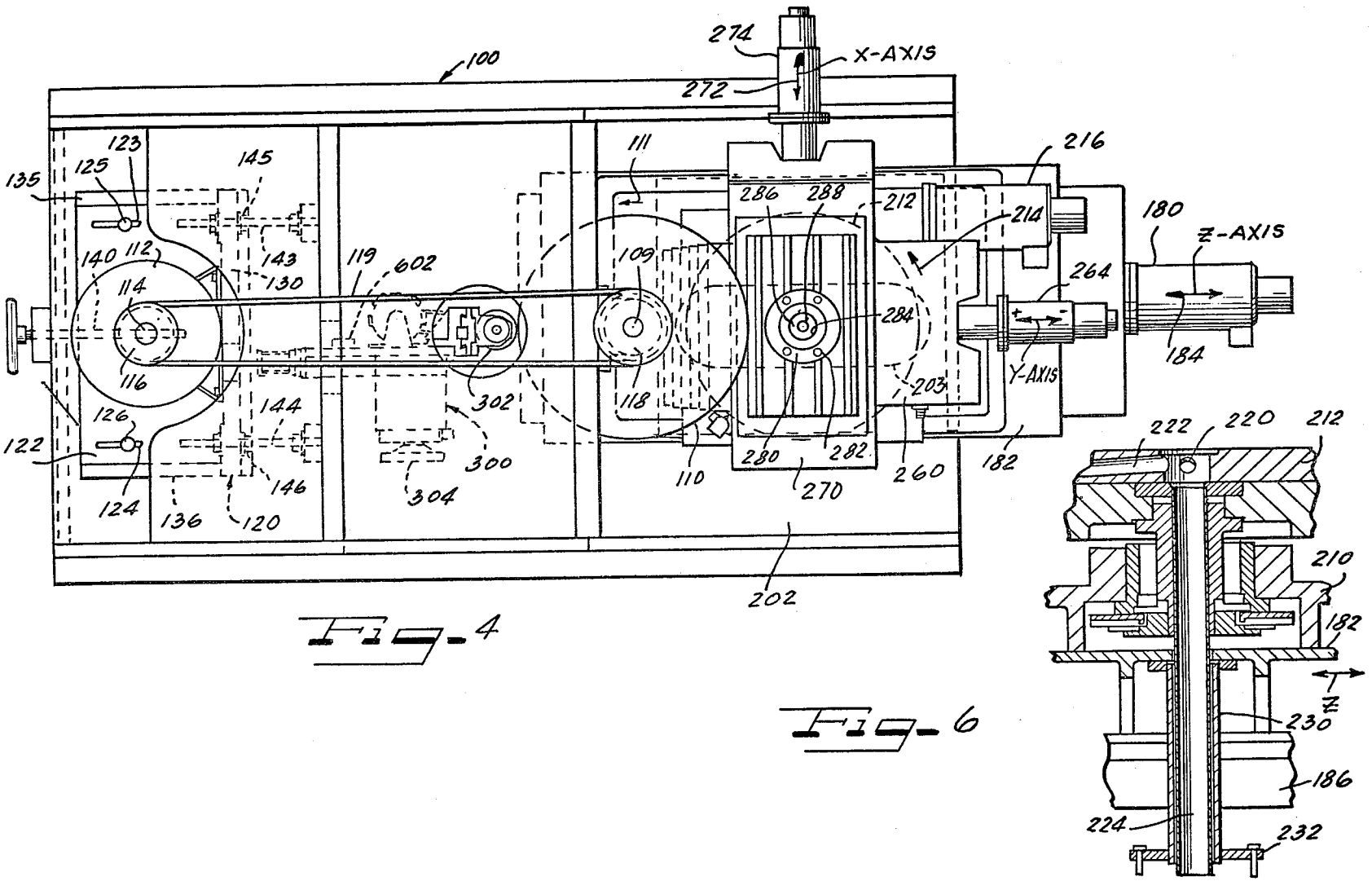
FIG. 4 is a diagrammatic plan view of an actual embodiment of the present invention.
FIG. 6 (on sheet two of the drawings) is a somewhat diagrammatic partial enlarged longitudinal sectional view taken in a plane through the axis of rotation of the rotary table of the apparatus of FIG. 4.

Referring to FIG. 4, a grinding machine as successfully built and operated is illustrated in a top plan view. A machine frame 100 mounts a spindle 109 for grinding wheel 110. The grinding wheel is driven in the direction of arrow 111 from a motor 112 having a motor shaft 114. A sheave 116 on the motor shaft 114 drives a sheave 118 on the grinding wheel shaft 109 by means of a drive belt 119. Motor 112 is carried on a motor mount 120 which includes a horizontal plate 122 with elongated slots such as 123 and 124. Thus reciprocal movement of the motor mount 120 is guided by means of cap screws such as 125 and 126. A vertically disposed motor plate 130 is secured to horizontal plate 122 by means of side flange members 135 and 136. An adjusting screw is indicated at 140 (at the left center in FIG. 4) for shifting the motor mount 120 over the range of adjustment permitted by the slots 123 and 124. The motor mount 120 is locked in a desired position by means of screw members 143 and 144 having cooperating nuts such as 145 and 146. The arrangement is such that the position of the motor 112 may be adjusted to accommodate desired sheave diameters by means of the adjusting screw 140, the nuts associated with screws 143 and 144 serving to lock the motor mount 120 at a position providing the desired tension of belt 119.

Figure 5:
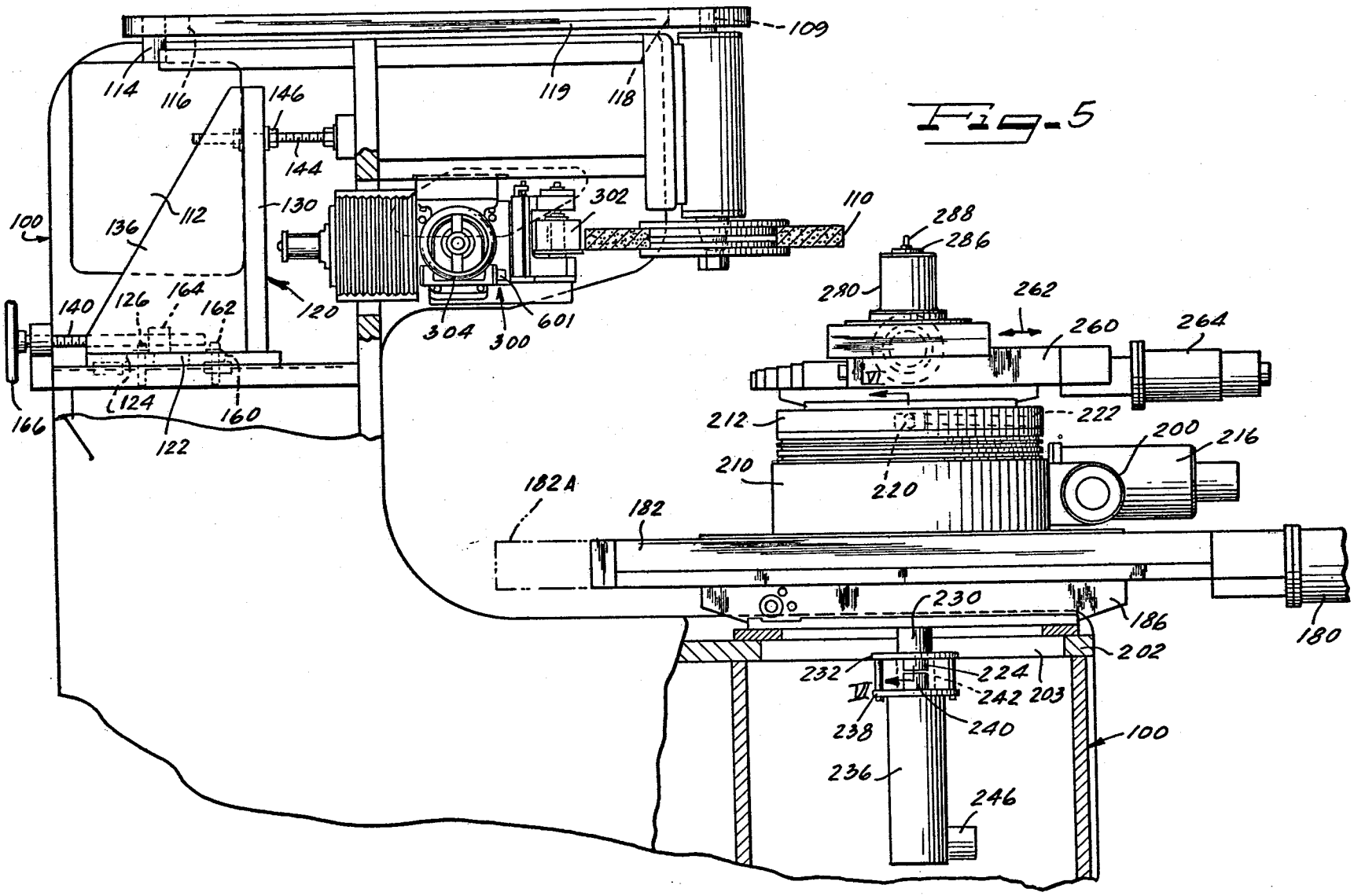
FIG. 5 (on sheet three of the drawings) is a somewhat diagrammatic partial longitudinal sectional view of the apparatus of FIG. 4, and illustrating various of the parts in side elevation.

As seen in FIG. 5, horizontal motor plate 122 may have further elongated slots such as indicated at 160 receiving further cap screws such as 162, and the adjusting screw 140 may cooperate with a threaded block 164 secured to the horizontal plate 122. A hand wheel is indicated at 166 on the end of the adjusting screw 140 for use in adjusting the motor mount 120.

Figure 7:
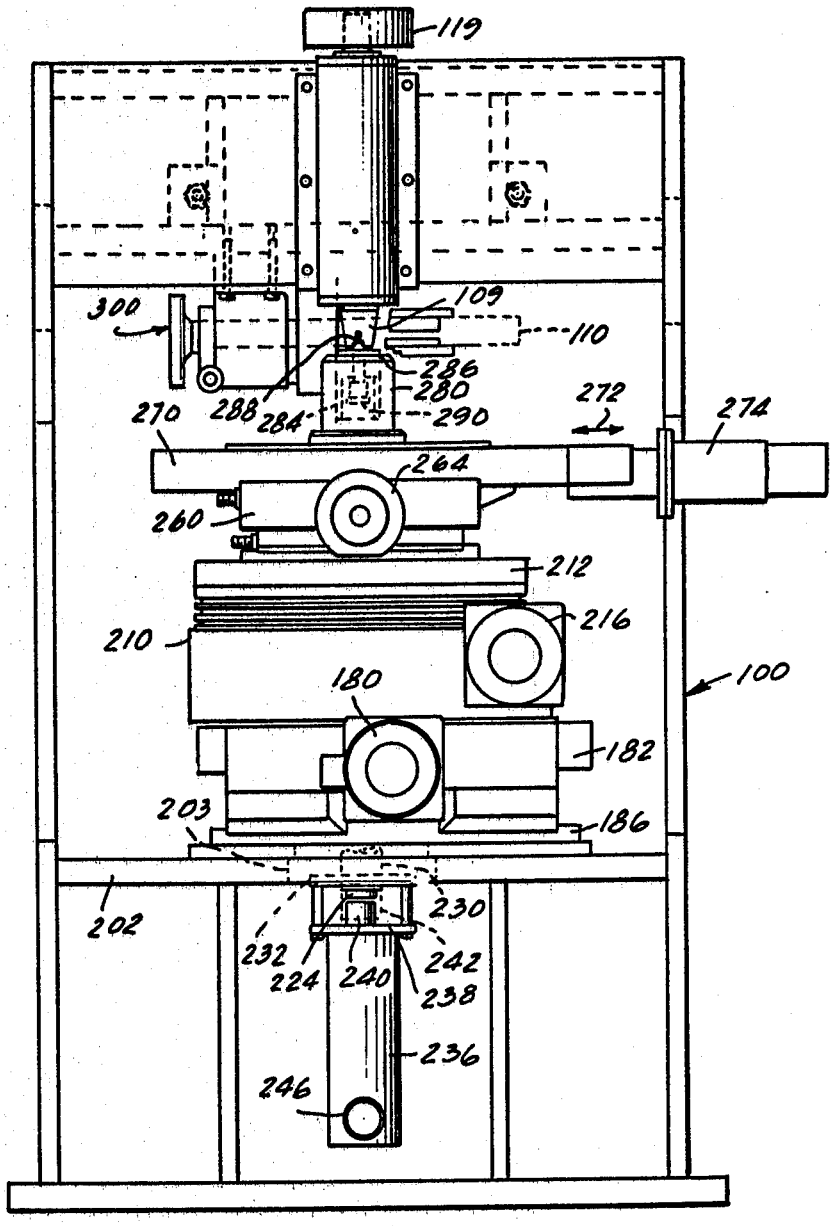
FIG. 7 is a somewhat diagrammatic end elevational view of the apparatus of FIG. 4 as viewed from the right hand side of FIG. 4.

Referring to FIG. 4, a Z-axis drive motor 180 is indicated at the extreme right which is operable for moving a Z-axis slide 182 in a Z direction as indicated by the double headed arrow 184. As indicated in FIG. 6, the Z slide 182 may be supported by means of a base 186. The motor 180 may be secured to the base 186 as shown in FIG. 7. The drive for the Z slide 182 may include a lead screw (not shown) extending parallel to the Z-axis indicated by arrow 184 with a resolver (not shown) and a tachometer (not shown) in line with the lead screw without any gear reduction between the motor 180 and the lead screw.

By way of example, the Z slide 182 may have a range of travel in the Z direction as indicated at 184 in FIG. 4 of 460 millimeters (18.110 inches). The Z slide 182 is shown in FIGS. 4 and 5 at a midpoint in its range of travel, and the extreme of its travel in a direction toward the grinding wheel 110 is indicated in dot dash outline at 182A in FIG. 5. As seen in FIG. 7, the frame 100 includes a bed plate 202 which is provided with an elongated aperture 203 for accommodating movement along the Z-axis of certain parts movable with the slide 182.

Mounted on the Z-axis slide 182 is a table support structure 210, FIG. 6, carrying a rotary table 212 which is angularly movable in a counter-clockwise direction as indicated by arrow 214 in FIG. 4. The table 212 is driven in the direction of arrow 214 by means of a R-axis drive motor 216, FIG. 5. The motor 216 drives the table 212 via a suitable speed reduction, for example of 180 to 1, and a resolver (not shown) may be mounted in line with the motor for direct drive by the motor without any speed reduction. Thus, the resolver rotates 180 times per table revolution. The table 212 is indefinitely rotatable in the direction of arrow 214 and makes a number of revolutions as the grinding wheel 110 makes successive cuts on the workpiece. As indicated at 220 and 222 in FIGS. 5 and 6, the table 212 is provided with radially extending passages which open at the outer perimeter of the table for receiving electric cables which are lead via the passage to a central tube 224, FIG. 6.

The passages 220 and 222 provide for electrical connections with the drives for the X and Y axes which are carried on the table 212. As seen in FIG. 6, the Z-axis slide 182 carries a depending sleeve 230 having a flange 232. The flange 232 serves to support a slip ring assembly 236, FIG. 5, which has a cooperating flange 238 at the upper end thereof. Rotatably mounted within the slip ring assembly 236 is a slip ring shaft 240 which is coupled for joint rotation with tube 224 by means of a rubber hose coupling as indicated at 242. The purpose of the coupling 242 is to prevent the exertion of any lateral forces on the slip ring bearings. By way of example the slip ring assembly 236 may be provided with stationary silver carbide brushes which cooperate with the slip rings to transmit the various electrical signals via a fitting indicated at 246, FIG. 5.

Mounted on the rotary table 212 is a Y-axis slide 260 which may have a range of movement parallel to a Y axis as indicated by arrow 262 in FIG. 5. The slide 260 is driven by means of a Y-axis motor 264, and by way of example may have a range of movement of 160 millimeters (6.300 inches). The Y-axis slide 260 is shown at a midpoint in its range of movement in FIG. 4. Referring to FIG. 7 an X-axis slide 270 is shown for reciprocal movement as indicated by arrow 272 on the Y-axis 260, and an X-axis drive motor 274 is indicated for reciprocating the slide 270 relative to the X axis. By way of example, slide 270 may have a range of movement of 160 millimeters (6.300 inches), the same as the Y-axis range of movement.

Mounted on the X-axis slide 270 is a hydraulic expansion chuck 280 secured to the X-slide 270 by means of cap screws such as indicated at 282, FIG. 4. The chuck may have a central bore 284, FIG. 4, with a diameter for example of 3.000 inches. At a lower portion of the bore 284, the chuck may be provided with radial holes opening into the bore 284 from the outer periphery and disposed at angles such as 0°, 45°, 90°, 120°, 150°, 210°, 240° and 315° to provide for the positioning of interchangeable sleeves such as sleeve 286 at different desired angles relative to the X-axis. The various sleeves such as 286 are designed to rigidly retain work blanks such as the workpiece indicated at 288 in FIG. 4. As seen in FIG. 5, workpiece 288 is thus fixedly supported in the chuck at a level so as to cooperate with the outer cylindrical periphery of grinding wheel 110. As seen in FIG. 7, a keying pin such as 290 may be inserted through aligned holes in the wall of the chuck 280 and in the sleeve 286 so as to retain the workpiece 288 at the desired angular relationship to the X axis. Generally, the chuck 280 is provided with a thin wall surrounding the sleeve 286, with a cavity interiorly of the thin wall receiving a silicone substance which can be pressurized by means of a screw operated piston so as to deform the thin wall into locking engagement with the exterior cylindrical wall of the sleeve 286. The construction of the chuck 280 is consistent with overall accuracies of about three tenthousandths of an inch.

A grinding wheel dressing mechanism is indicated at 300 in FIG. 5 and includes a diamond dresser 302 which is arranged to be moved parallel to the Z axis into dressing relation to the outer cylindrical surface of the grinding wheel 110. The dressing mechanism may include a manually operated hand wheel 304 for manual control of the dresser when desired, and may also include an automatic drive for accurately positioning the dresser 302 relative to the grinding wheel during a dressing cycle.

Coolant is applied to the grinding wheel 110 in advance of its contact with the work 288, the work is flooded with coolant, and the wheel is cleaned by counter-forced coolant. By way of example, the coolant nozzles may be kept in proper close relation to the wheel 110, and the position of the coolant nozzles may be adjusted as the diameter of the grinding wheel changes through successive dressing cycles by means of the dressing mechanism 300. For example, if the grinding wheel might have an initial diameter of 24 inches, and be suited to dressing down to an 18 inch diameter, then the coolant nozzles might be adjustable over a three inch range relative to the grinding wheel axis. The position of the coolant nozzles could be automatically adjusted inwardly in response to successive dressing cycles of the dressing mechanism 300 if desired, so as to maintain an optimum close relationship between the nozzles and the outer periphery of the grinding wheel.

The Grinder Control System of FIGS. 8–12

Figure 8:
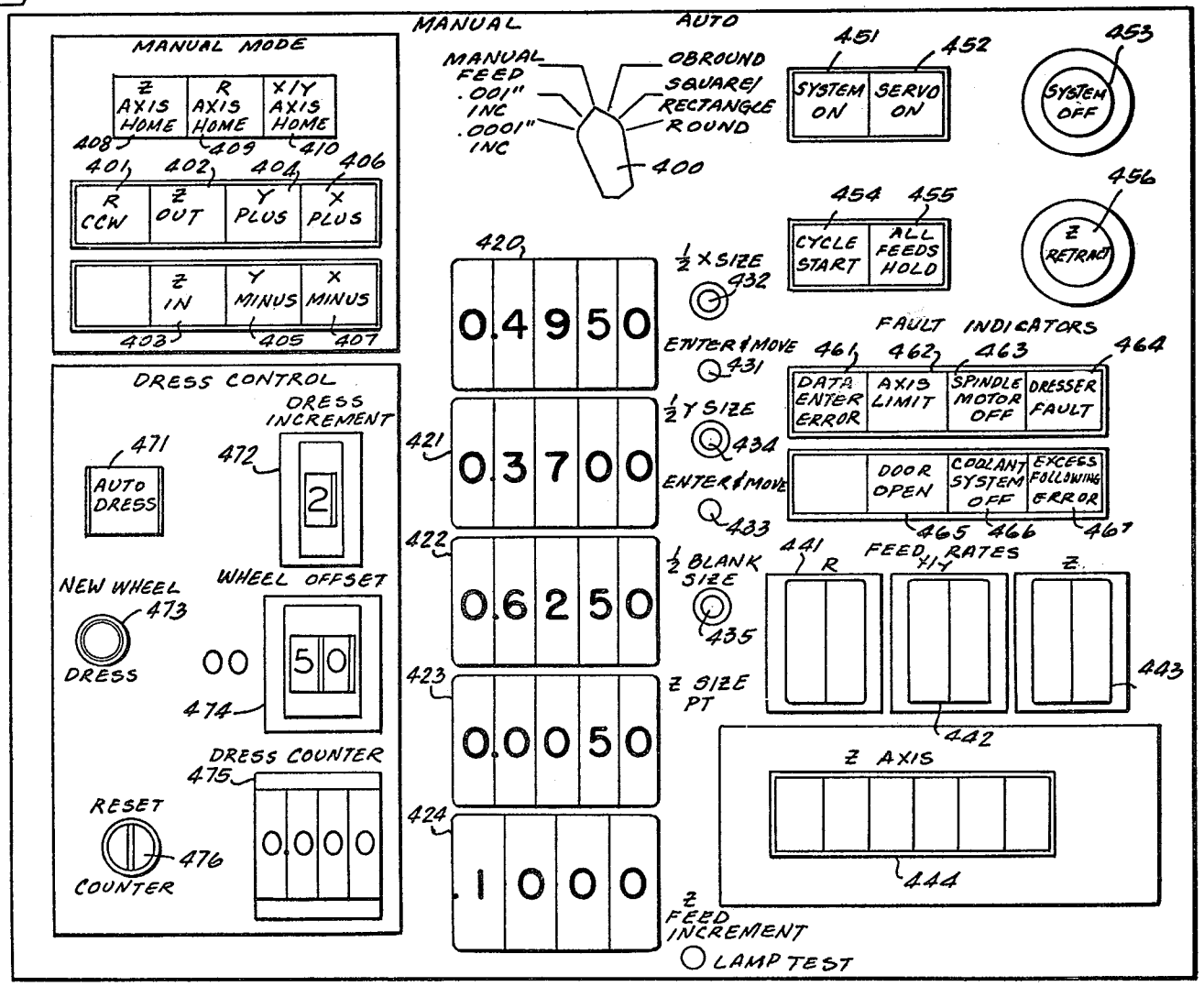
FIG. 8 is a diagrammatic plan view showing the layout of a control panel for the apparatus of FIGS. 4 through 7.

FIG. 8 is a diagrammatic illustration of a control panel for the grinding machine of FIGS. 4–7. A mode selector is indicated at 400 which has three manual control positions and three automatic positions. In the first two manual positions of selector 400, the drives are operated in a step mode so as to step a predetermined increment (one ten-thousandth of an inch in the first position and one thousandth of an inch in the second position) upon each actuation of the manual mode control buttons 401–407. In the third "Manual Feed" position of selector 400, a drive is energized so long as the corresponding control button 401–407 is held actuated. In any of the manual mode positions of selector 400, actuation of the control buttons 408–410 result in the return of the Z-axis slide 182, rotary table 212 and the Y-axis and X-axis slides 260 and 270 to their respective home positions.

If the workpiece such as 288 is to be ground to an obround configuration by automatic operation of the system, selector 400 is to be placed in its fourth position, while the fifth position is used for automatic grinding of square or rectangular configurations, and the extreme clockwise position of selector 400 is used for the grinding of work configurations.

In setting up the system for automatic operation, parameters relating to the workpiece are entered by means of manually operated data input switches 420–424. Once a dimension has been set-up on the one-half X size switch 420 (such as 0.4950 inch as shown in FIG. 8), an enter move button 431 may be actuated to cause the dimension to be stored in memory and automatically executed. At the completion of the X-axis move in accordance with the entered dimension, an indicator light 432 will be lit to indicate to the operator that the desired move has been executed.

Similarly for the one-half Y size switch 421, once a dimension (such as 0.3700 inch as shown) is entered, a button 433 may be depressed to cause the dimension to be entered and automatically executed. When the Y-axis move has been executed, indicator light 434 is energized.

The switch 422 serves to enter a dimension (such as 0.6250 inch) representing one-half of the width dimension of the blank or workpiece such as 22, FIGS. 1–3, this dimension in the illustrated embodiment being disposed parallel to the Y axis. An indicator light 435 is energized at a suitable point in the automatic operation as will hereafter be explained.

The switch 423 serves to enter a dimension (such as 0.0050 inch) which represents a "Z size point" as will hereafter be explained.

The switch 424 serves to introduce a value (such as 0.1000 inch) which is termed the "Z feed increment", and represents the desired normal advance of the Z-axis slide 182.

Further manual data input devices are indicated at 441–443 for selecting desired feed rates for the R (rotary table) axis, the X-axis and the Y-axis slides, and the Z-axis slide, respectively.

The reference numeral 444 designates a six decimal digit readout section which is under the control of the computer and serves to supply a readout of Z-axis position.

Control buttons 451 through 456 are designated respectively "System On", "Servo On", "System Off", "Cycle Start", "All Feeds Hold", and "Z Retract".

Fault indicator lights are indicated at 461–467 and may be selectively controlled by the computer to indicate the following respective conditions: "Data Enter Error", "Axes Limit", "Spindle Motor Off", "Dresser Fault", "Door Open", "Coolant System Off", and "Excess Following Error".

A dress control section of the control panel at the lower left comprises elements 471–476. Reference numeral 471 designates a control switch for activating an "Auto Dress" feature whereby the grinding wheel is automatically dressed. The actuating button 471 is illuminated in response to a first actuation to indicate auto dress mode, and the illumination is extinguished when the button 471 is actuated a second time to leave auto dress mode.

Element 472 is a manual data input switch having one decimal digit representing dress increments in thousandths of an inch. Thus with the switch 472 set to the numeral two as shown, 0.002 inch is removed from the grinding wheel in each dressing cycle.

The control 473 serves to initiate a dressing operation of a new grinding wheel, and may bear the notation "New Wheel Dress".

The manual data input switch 474 may have two decimal digits of adjustment representing thousandths and ten-thousandths of an inch of grinding wheel offset, so that in the illustrated condition, the grinding wheel offset is 0.0050 inch.

Element 475 is a mechanical dress counter which serves to maintain a count of dress cycles independent of power supply for the system. Accordingly, after a power shut-down, the dress counter 475 will still register the relevant dress count, so that the computer can determine the condition of the grinding wheel, and resume operation accordingly. Element 476 is manually actuated to reset the dress counter 475.

Figure 9:
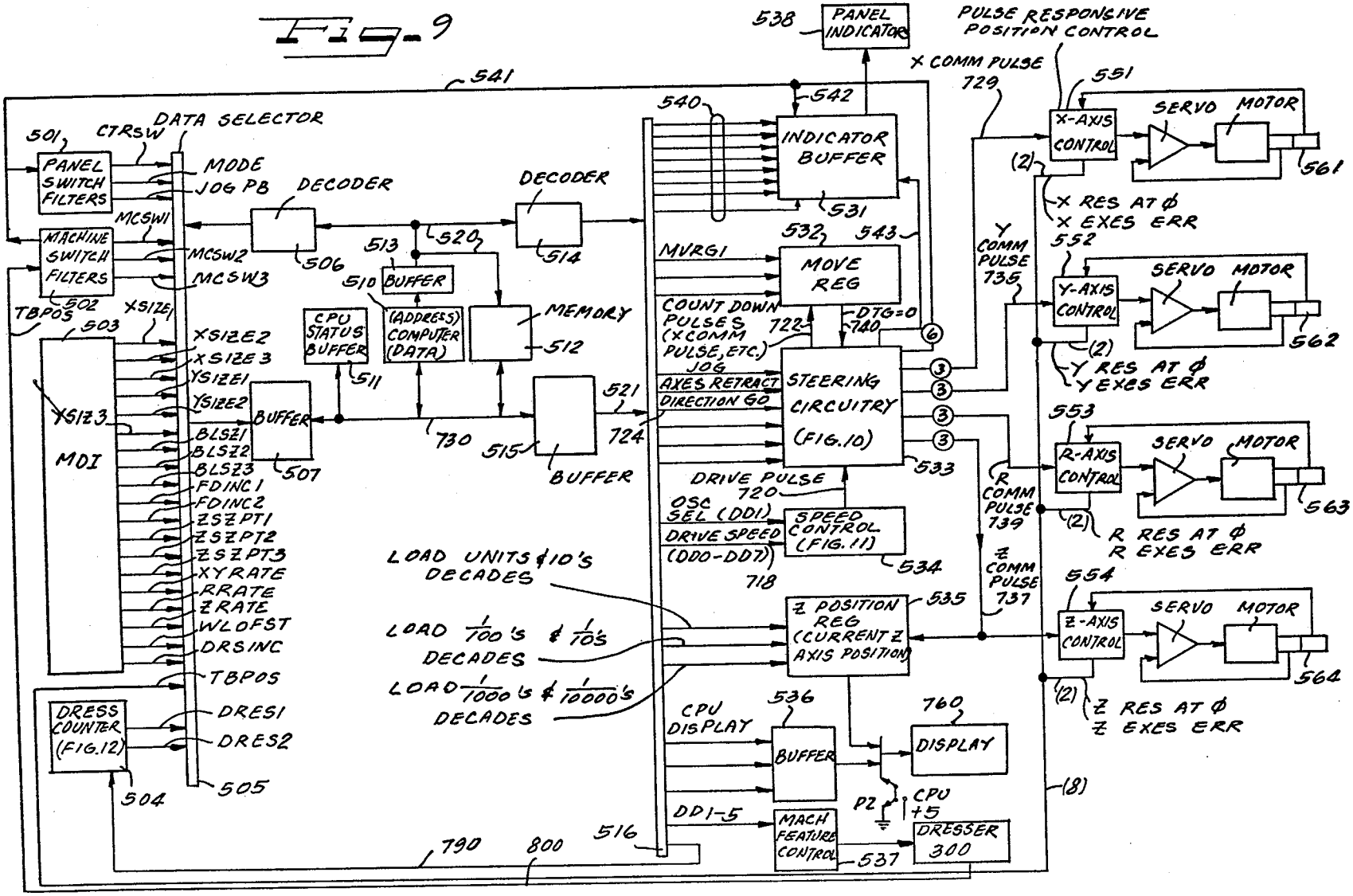
FIG. 9 is a block diagram illustrating, for purposes of example only, a control system which has been successfully applied to the apparatus of FIGS. 4 through 8.
Figure 11:
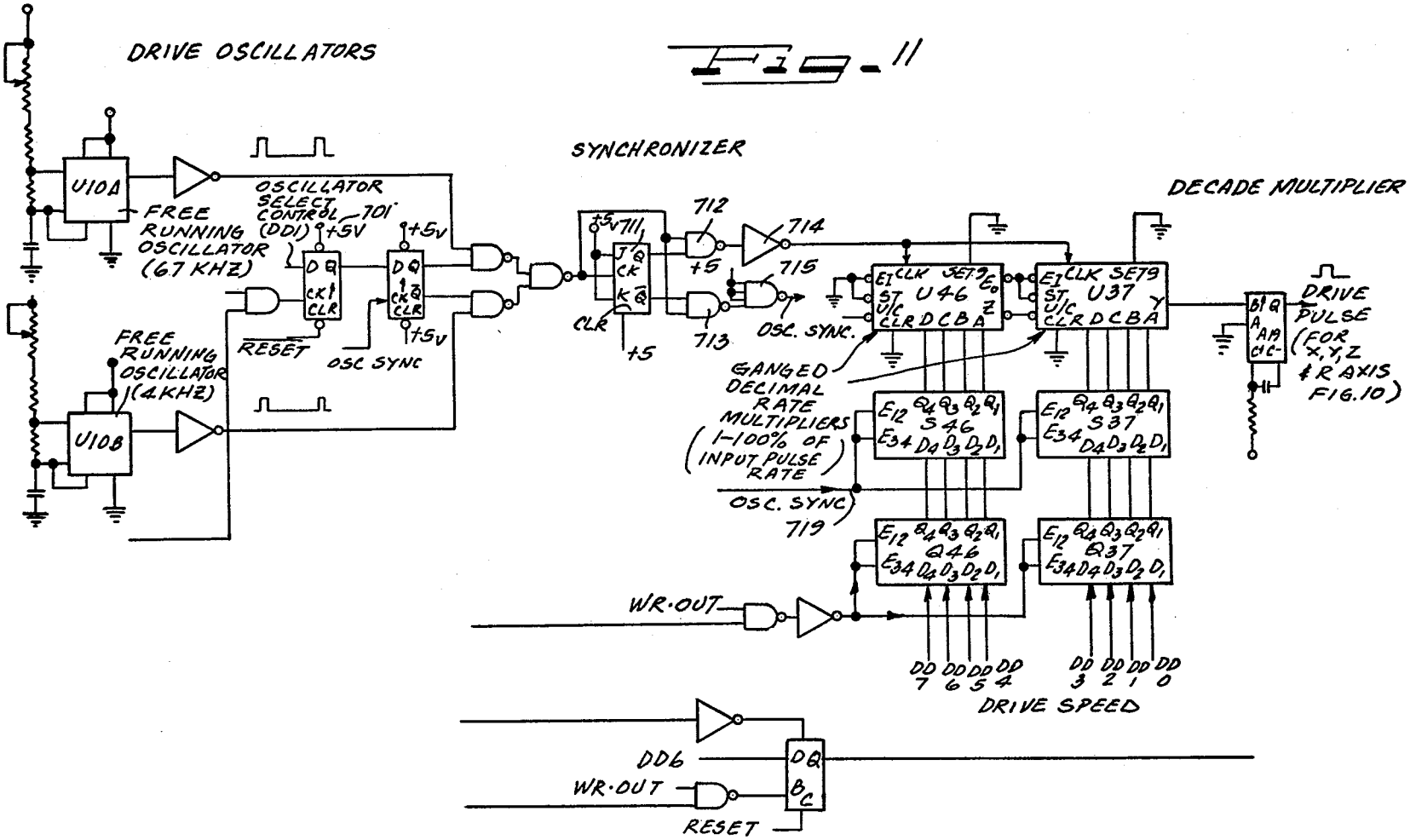
FIG. 11 is a detailed electric circuit diagram for the Indicator Buffer and Speed Control Components of the system of FIG. 9.
Figure 12:
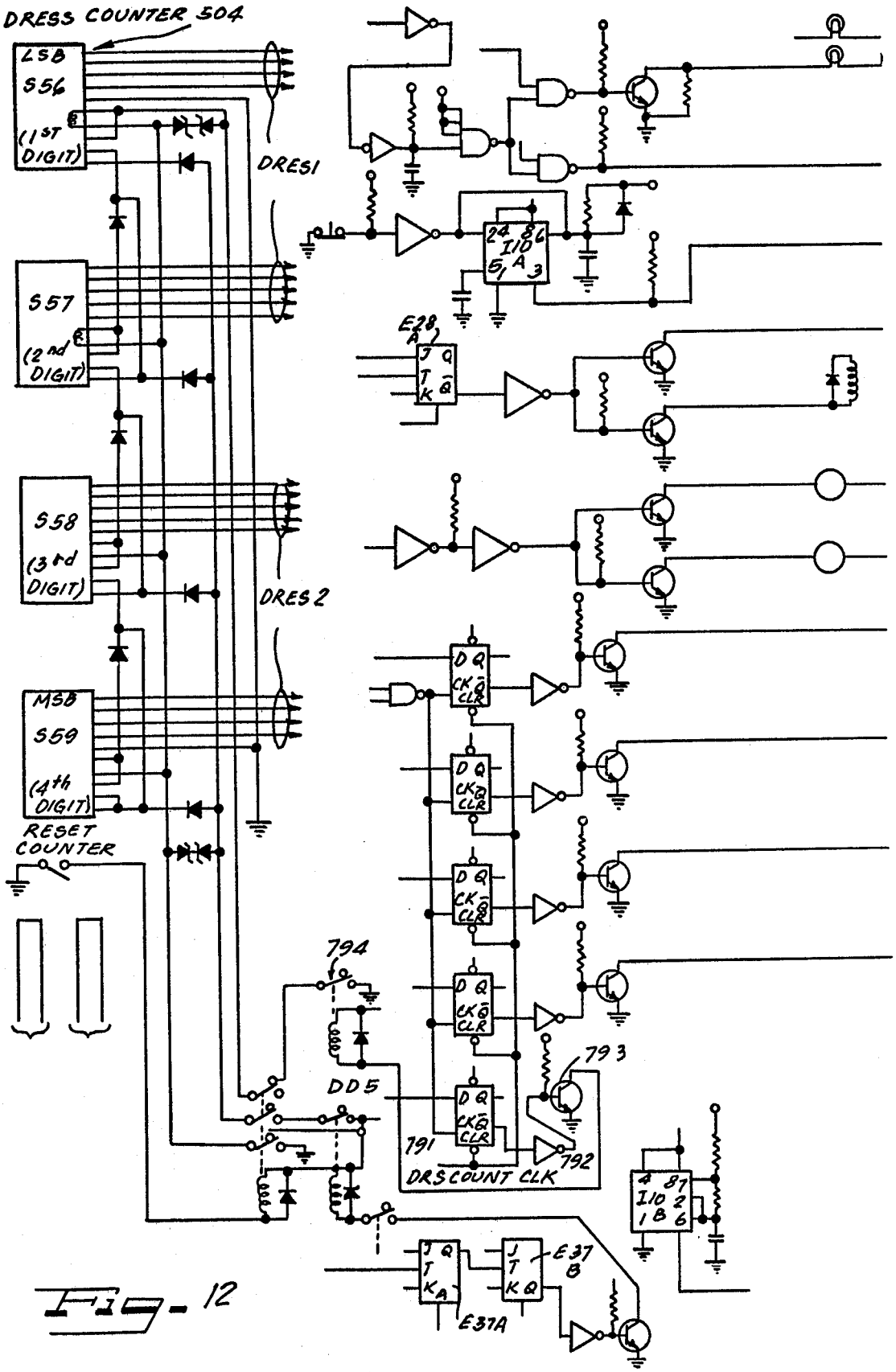
FIG. 12 is a circuit diagram showing the electrical connections to the mechanical dress cycle counter and other miscellaneous circuitry.

FIG. 9 is a block diagram of the control system for the grinding machine of FIGS. 4–7. Panel switch filters components 501 represents switch filter circuitry for supplying logical output signals to respective eight channel input ports as represented by the designations CTRSW, MODE, and JOGPB. These output signals are generated in response to actuation of respective switches of the control panel of FIG. 8 as set forth in the tabulations on the following pages.

Tabulation of Logical Outputs from the Panel Switch Filters Component 501, FIG. 9

Control Switch Input Port (CTRSW)

| Switch Designation | Ref. No. | Logical Output Signal |
|---|---|---|
| R Axis Home | 409 | R TO HM |
| X/Y Home | 410 | X/Y TO HM |
| ½ X Size Offset | 431 | X OFST |
| ½ Y Size Offset | 433 | Y OFST |
| Cycle Start* | 454 | CYCL STRT |
| Feed Hold | 455 | FEED HLD |
| Emergency Z Retract** | 456 | EMR Z RTRCT |

-continued

Tabulation of Logical Outputs from the Panel Switch Filters Component 501, FIG. 9

Control Switch Input Port (CTRSW)

| Switch Designation | Ref. No. | Logical Output Signal |
|---|---|---|
| Servo On*** | 452 | SERVO ON RY SF |

*The cycle start switch 454, FIG. 8, upon closing produces a signal CYCL STRT CTRL which is logically OR ed with a signal CYCL STRT MACH SF produced by a switch designated "CYCL STRT MACH" located on the grinding machine proper. Actuation of either switch will serve to transmit the signal "CYCL STRT" at bit 4 of the control switch input port.

**The emergency Z restract switch 456, FIG. 8, produces a signal EMR Z RTRCT CTRL which is logically OR ed with a signal EMR Z RTRCT MACH SF from a switch "EMRGNCY Z RTRCT MACH" located at the grinding machine proper. Either signal, of course, will be effective to generate the EMR Z RTRCT signal.

***The servo on switch 452, FIG. 8, controls a servo-on relay. A circuit including a normally open contact of this relay is coupled to a switch filter so that when the relay is energized, the switch filter supplies the signal SERVO ON RY SF.

Mode Input Port (MODE)

| Switch Designation | Logical Output Signal |
|---|---|
| Selector Switch 400 | |
| Position One | .0001 INC |
| Position Two | .001 INC |
| Position Three | MAN FEED |
| Position Four | OBROUND |
| Position Five | SQ/REC |
| Position Six | ROUND |
| Auto Dress Switch 471 | AUTO DRS |
| New Wheel Dress Switch 473 | NEW WHL DRS |

Jog Pushbutton Input Port (JOG PB)

| Switch Designation | Ref. No. | Logical Output Signal |
|---|---|---|
| X Plus | 406 | X PLS |
| X Minus | 407 | X MINUS |
| Y Plus | 404 | Y PLS |
| Y Minus | 405 | Y MINUS |
| Z Out | 402 | Z OUT |
| Z In | 403 | Z IN |
| R CCW | 401 | RCCW |
| Z Axis Home | 408 | Z TO HM |

The control panel of FIG. 8 in an existing embodiment is located remote from the grinding machine per se, and the grinding machine per se is completely enclosed for safety purposes, with a door which provides access to the grinding machine being closed during normal operation of the machine so that the machine operates out of the view of the operator. In order to supply information as to the operation of the grinding machine, various switches are provided at the grinding machine, and the condition of these switches is transmitted by means of a machine switch filters component 502 indicated in FIG. 9. The various switches which are provided in the existing installation are listed in the following tabulation which shows the logical outputs which are transmitted via the respective eight-channel ports designated MCSW1, MCSW2 and MCSW3 in FIG. 9.

Tabulation of Logical Outputs from the Machine Switch Filters Component 502, FIG. 9

Machine Control Switch Input Port One (MCSW1)

| Switch Designation | Logical Output |
|---|---|
| Plus X-Axis Overtravel | X + O.T SF |
| Minus X-Axis Overtravel | X − O.T SF |
| X-Axis Home Zone | X ZERO SF |
| Plus Y-Axis Overtravel | Y + O.T SF |
| Minus Y-Axis Overtravel | Y − O.T SF |
| Y-Axis Home Zone | Y ZERO SF |
| R-Axis Slow Down | R SLO DN SF |
| R-Axis Home Zone | R ZERO SF |

-continued

Tabulation of Logical Outputs from the Machine Switch Filters Component 502, FIG. 9

Machine Control Switch Input Port Two (MCSW2)

| Switch Designation | Logical Output |
|---|---|
| Plus Z-Axis Overtravel | Z + O.T SF |
| Minus Z-Axis Overtravel | Z − O.T SF |
| Z-Axis Slow Down | Z SLO DN SF |
| Z-Axis Home Zone | Z ZERO SF |
| Dress Cycle On | DRS CYCL ON SF |
| R-Axis Brake On | R BRAKE ON SF |
| Machine indicator on (See FIG. 10 for the logical circuitry controlling this output signal.) | MACH IND ON |

Machine Control Switch Input Port Three (MCSW3)

| Switch Designation | Logical Output |
|---|---|
| Spindle Off | SPINDL OFF SF |
| Door Open | DOOR OPN SF |
| Coolant Off | CLNT OFF SF |
| Dresser Fault | DRSR FLT SF |

Component 503 in FIG. 9 is designated MDI, and represents the circuitry associated with the various manual data input switches of FIG. 8 for registering and transmitting (in binary coded decimal notation) the manually entered numbers. The coded information associated with the respective eight-channel ports such as X SIZE1 in FIG. 9 are set forth in the following tabulation which is self-explanatory.

MANUAL DATA INPUT COMPONENT 503, FIG. 9

| Input Port Designation in FIG. 9 | Description of the Associated MDI Component of FIG. 8 |
|---|---|
| X SIZE 1 | Two least significant digits of ½ X size input switch 420 (in binary coded decimal) |
| X SIZE 2 | Hundredths and tenths digits of ½ X size input switch 420 |
| X SIZE 3 | Most significant (units) digit of ½ X size input switch 420 |
| Y SIZE 1 | Two least significant digits of ½ Y size input switch 421 |
| Y SIZE 2 | Hundredths and tenths digits (0.01 inch and 0.1 inch) of the ½ Y size input switch 421. |
| Y SIZE 3 | Most significant (units) digit of ½ Y size input switch 421. |
| BLSZ1 | Two least significant digits of the ½ blank size switch 422. |
| BLSZ2 | Hundredths and tenths digits of the ½ blank size switch 422. |
| BLSZ3 | Most significant (units) digit of the ½ blank size switch 422. |
| FDINC1 | The ten thousandths and thousandths digits (eight bits in binary coded decimal notation) from the Z feed increment switch 424. |
| FDINC2 | The hundredths and tenths digits from the Z feed increment switch 424. |
| ZSZPT1 | The ten thousandths and thousandths (of an inch) digits from the Z size point switch 423. |
| ZSZPT2 | The hundredths and tenths digits from switch 423. |
| ZSZPT3 | The units digit from switch 423. |
| XYRATE | The two digits from the X/Y feed rate manual input device 442. |
| RRATE | The two digits from the R feed rate input device 441. |
| ZRATE | The two digits from the Z feed rate input device 443. |
| WLOFST | The two digits of the wheel offset input switch 474 (representing ten thousandths and thousandths of an inch) |
| DRSINC | The single decimal digit of dress increment input switch 472 (representing thousandths of an inch and transmitted in parallel as four bits with weights of 1, 2, 4 and 8 in binary coded decimal notation) |

-continued

MANUAL DATA INPUT COMPONENT 503, FIG. 9

| Input Port Designation in FIG. 9 | Description of the Associated MDI Component of FIG. 8 |
|---|---|
| | coded decimal notation) |

Dress counter component 504 in FIG. 9 is shown as having two eight-channel ports DRES1 and DRES2 for supplying the count of the mechanical counter component 475, FIG. 8. The following table with respect to these two ports is presented for the sake of uniformity.

DRESS COUNTER COMPONENT 504, FIG. 9

| Inport Port Designation in FIG. 9 | Description of the Associated Component of FIG. 8 |
|---|---|
| DRES1 | The two least significant digits from the dress counter 475 (each transmitted in parallel as four binary bits with weights of 1, 2, 4 and 8 in binary coded decimal notation). |
| DRES2 | The two higher order digits of dress counter 475 (each transmitted in binary coded decimal as for DRES1) |

The foregoing eight channel ports are all connected as inputs to a data selector component 505 which may be implemented as a conventional multiplex arrangement controlled by means of decoder component 506. The selected 8 bit word is supplied by component 505 to a buffer component 507. Buffer component 507 is illustrated as being conventionally associated by means of a suitable data bus configuration with a data processing system including a computer component 510, a central processing unit (CPU) status buffer component 511 and a memory component 512. The address of data to be supplied from the data selector 505 may be transmitted from the computer 510 via a buffer 513 to the decoder 506. In the existing installation, the input line to buffer 507 from selector 505 is an eight-channel bus, and the input line to decoder component 506 is also an eight channel bus.

Since the computer system represented by components 505–507, and 510–516 in FIG. 9 is essentially a commercially available system, detailed discussion is deemed unnecessary. The computer system basically receives data words from the respective eight-channel input ports such as CTRSW under the control of data selector 505. The data selector 505 receives the address of a desired input port from the computer system via decoder component 506. After processing in accordance with information received from the input ports, the computer system may supply a desired address to decoder 514 via an eight-channel buss 520, the decoder 514 controlling the data selector or multiplex component 516 so that the data word is transmitted from buffer component 515 via eight channel buss 521 to a selected one of the components such as indicated at 531–537.

The reference numeral 540 represents an output port consisting of eight channels which serve to transmit the following respective signals:

CYCL STRT, FEED HLD, DATA ENTR ERR, X SIZE, Y SIZE, BLANK SIZE, Z IN FLASH, Z HM FLASH.

The indicator buffer component 531 responds to the respective signals received by output port 540 to energize the respective corresponding indicator lamps on the control panel of FIG. 8, the panel indicators being collectively represented by component 538. In particular, the foregoing listed signals transmitted by the respective channels of the output port 540 will cause the energization of the lamps associated with elements 454, 455, 461, 431, 433, 435, 403 and 408 of the control panel of FIG. 8. Line 541 which is shown extending from the machine switch filters component 502 may include a five conductor line indicated at 542 connecting with the indicator buffer component 531. The signals transmitted by lines 541 and 542 to component 531 may be the following:

$\overline{\text{SPINDL OFF}}$, $\overline{\text{DRSR FLT}}$, $\overline{\text{DOOR OPN}}$, and $\overline{\text{CLNT OFF}}$.

These respective signals control the energization of indicator lamps associated with indicators 463, 464, 465 and 466, these indicators being designated respectively "spindle motor-off", "dresser fault", "door open", and "coolant-off", Thus, indicators 463–466 are shown as being directly controlled from machine switch filters component 502 at the grinding machine, independently of the transmission of these signals via the input port MCSW3.

Other signals are supplied from steering circuitry component 533 to buffer component 531 as indicated by line 543. By way of example, line 543 may include conductors for transmitting the following signals:

$\overline{\text{X/Y AT HM}}$, $\overline{\text{Z AT HM}}$, $\overline{\text{R AT HM}}$, $\overline{\text{AXS LIMIT}}$ and $\overline{\text{EXES FWG ERR}}$ These signals may control the energization of indicator lights associated with components 410, 408, 409, 462 and 467 of FIG. 8. The steady energization of these indicator lights indicate respectively the following conditions: both X-axis and Y-axis slides at the respective home positions, the Z-axis slide at the home position, the R-axis table at its home orientation, one or more of the X-axis, Y-axis and Z-axis limit switches actuated to indicate an overtravel condition of the associated slide, and an excess servo error from any one of the X-axis control 551, and Y-axis control 552, the R-axis control 553 or the Z-axis control 554.

The information supplied by the axis control components 551–554 to the input port designated TBPOS are listed as follows:

X RES AT $\phi$, X EXES ERR, Y RES AT $\phi$, Y EXES ERR, R RES AT $\phi$, R EXES ERR, Z RES AT $\phi$, and Z EXES ERR.

The first of the signals from each of the controls 551–554 reflects an electrical zero condition of the corresponding resolver, the resolver components being indicated at 561–564 at the right in FIG. 9. Component 533 may receive signals such as X RES AT $\phi$ and $\overline{\text{X ZERO SF}}$ and generate the signals such as X AT HM.

The wheel dress assembly 300 is a commercially available unit known as a Tru-Grid Rotary Diamond Dressing Wheel Assembly manufactured by Wheel Trueing Tool Co., and includes a micrometer 601 which controls the incremental distance the dresser slide is moved in response to each electric pulse. In the illustrated embodiment the setting is such that each electric pulse produces one mil of movement of the dresser slide toward the grinding wheel. The dress increment switch 472, FIG. 8, controls how many pulses are produced in each dress cycle, and can be set to produce any number of such pulses between zero and nine.

In setting up a new dress cycle handwheel 304 is first turned to move the slide carrying dresser 302 away from the grinding wheel until a gage stop 602, FIG. 4, abuts the slide. The handwheel 304 is then turned in the opposite direction until a dial calibrated in onethousands of an inch shows that the dresser has been moved a predetermined number of mils. The new wheel dress switch 473 is then actuated to cause the dresser slide to be advanced a predetermined distance, say 0.175 inch, to provide the new grinding wheel with a given diameter, in readiness for subsequent operation in grinding shapes.

The operation of the embodiment of FIGS. 4–12 is similar to that described with reference to FIGS. 1–3 except that the ½ X-size and ½ Y-size moves are executed at the time of manual entry when the associated data entry button (431 or 433) is depressed. The work is then advanced at a rapid rate a distance determined from the known distance to the grinding wheel 110 corresponding to $Z_0'$ in FIG. 1, adjusted by an Z-axis offset entered at 474 and the ½ blank size value entered at 422. With the specific arrangement as represented in FIG. 8, the blank is shifted relative to the Y-axis so as to take account of a distance equal to the Z-size point value entered at 423, FIG. 8 so that the axis of the rotary table 212 is inwardly of an edge portion of the blank such as indicated at 610 in FIG. 3A and underlies the blank at point 611, FIG. 3A, which point is aligned with the axis of the grinding wheel at the beginning of a grinding feed by the Z-axis motor. At this point the indicator light 435 will be energized.

The system now proceeds to feed the work toward the grinding wheel at the Z feed rate entered at 443, FIG. 8, and feeds a distance as registered at 424, FIG. 8. When the move register 532, FIG. 9, signals that the Z move is complete (by means of the signal DTG = 0 supplied to the steering circuitry component 533, FIG. 9), the system is ready for a move parallel to the X-axis (in the negative X direction) so that the tool blank 288 moves to the left and counter to the direction of wheel rotation indicated at 111 in FIG. 3A and FIG. 4.

Figure 3A:
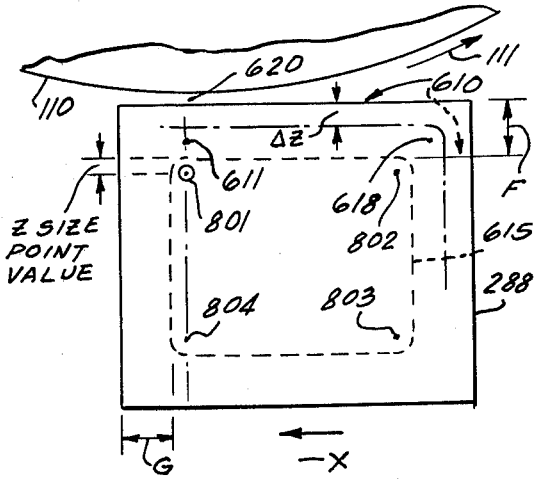
FIG. 3A is a view similar to that of FIG. 3 but illustrating the actual operation of the system of FIGS. 4–12.

When the cycle start button 454 is actuated to initiate a grinding operation, the computer 510 may read the entered values of one-half blank size ($Do/2$ in FIG. 3) and given as 0.6250 in FIG. 8; one-half Y size ($d/2$ in FIG. 3) and given as 0.3700 in FIG. 8; and Z size point ($e$ in FIG. 3) and given as 0.0050 at 423 in FIG. 8, and compute the width of the tool blank 288 which is to be removed at each side to reach the final size shown at 615 in FIG. 3A. This width is indicated at F in FIG. 3A and would be calculated as 0.2500 inch for the numerical example given. The computer would then compute an X initial move equal to two times the one-half X size entry at 420, FIG. 8, which would equal 0.9900, and then add a value equal to F, for a total of 1.2400, and subtract the Z feed increment of 0.1000 entered at 424, FIG. 8.

If the excess of the length of the blank 288, over the final tool size 615, is indicated at G in FIG. 3A, should exceed the value F, the one-half blank size value entered at 422 in FIG. 8 is increased by the operator by such difference, for the specific machine which has been successfully operated.

Thus, referring to FIG. 3A, once the initial Z-move is complete, the move register 532, FIG. 9, would be loaded with a value of 1.1400, and the move executed at the feed rate entered at 442, FIG. 8. At the completion of this move, the axis of table 212 would be under point 618, FIG. 3A, and the rotary drive 216 would be energized to effect a 90° rotation in the direction of arrow 214, FIG. 4.

Operation then proceeds as was described with reference to FIGS. 1–3. If the system is in auto dress mode as determined by button 471, the wheel dress mechanism will dress the wheel after each cycle by the amount set at 472 in FIG. 8, e.g. 2 mils, and the control will take this into account in the following cycle, by referring to the reading (of 0002) of the mechanical dress counter 475. In each cycle, the tool blank 288 always moves counter to the direction 111 of wheel surface movement and always contacts wheel 110 at the point about its periphery indicated at 620 in FIG. 3A. The feed of the successive axes in each cycle is sufficiently near continuous in relation to the time for a revolution of the grinding wheel so that the work is not subject to scratching during the final finish grinding cycles. The work may be retracted from the grinding wheel at the end of each cycle sufficiently quickly so that the work is not scratched (during the time when a dressing cycle is being initiated).

It will be apparent that many modifications and variations may be effected without departing from the scope of the novel concepts of the present invention.

I claim as my invention:

1. Grinding apparatus for forming noncircular punching tools comprising, a grinding wheel having a cylindrical peripheral surface and rotable on a central grinding wheel axis, a first slide mounted for movement along a first axis toward and away from said peripheral surface of said grinding wheel and carrying a rotary table rotatable on a table axis parallel to said grinding wheel axis, a second slide mounted on said rotary table and reciprocally movable along a second axis, a third slide mounted on said second slide and reciprocally movable along a third axis disposed at right angles to said second axis, and having means for securing a tool blank therewith with its tool axis parallel with said grinding wheel axis, and drive means coupled with said slides and with said rotary table for moving a tool blank into grinding contact with said peripheral surface and for sequentially activating said second and third slides and said rotary table to progressively remove material at four sides of said tool blank in succession in a grinding cycle and to advance the work further toward said grinding wheel and to repeat such grinding cycle a sufficient number of times to essentially form a noncircular punching tool of a predetermined noncircular cross sectional configuration.

2. Grinding apparatus according to claim 1 with means for establishing a predetermined initial distance along said first axis between the peripheral surface of said grinding wheel and the tool axis, and for establishing the position of said tool axis relative to said second and third axes, said drive means being operable to position the rotary table axis of said rotary table at a position displaced from said grinding wheel peripheral surface a distance corresponding to the radius of a circular arc to be formed at the surface of the tool blank and to position the rotary table axis at the center of such arc and thereafter to rotate such tool blank through an angle in accordance with the length of the desired circular arc.

3. Grinding apparatus according to claim 1, with initial distance establishing means comprising wheel dressing means for establishing the surface of the grinding wheel at a predetermined distance along said first axis relative to the tool axis.

4. Grinding apparatus according to claim 2, with said initial distance establishing means comprising wheel dressing means for fixing the surface of the grinding wheel at said predetermined distance along said first axis relative to the tool axis, with a precision at least substantially corresponding to plus or minus one mil.

5. The method of grinding a tool blank having a tool axis to form of noncircular punching tool, which method comprises mounting said tool blank on a system of slides carried by a rotary table with a table axis of rotation disposed parallel to a central grinding wheel axis of rotation of a grinding wheel, bringing the grinding wheel peripheral surface into grinding contact with a surface of said tool blank, actuating one of said slides to grind along a first side of the tool blank, activating said rotary table to form an arcuate face on said tool blank and activating one of said slides to grind along a further side of the tool blank, and successively activating said slides and said rotary table and moving the tool blank toward the grinding wheel in each of successive grinding cycles until essentially the final dimensions of the noncircular punching tool have been attained.

6. The method of forming cross-sectional shapes with straight planar sides and rounded corners, which comprises mounting a blank on one of a plurality of rectilinearly movable slides with axes at different angles carried on a rotary table with a rotary axis, relatively moving the blank and rotary table such that the rotary axis is inwardly of an edge portion of the blank which is to be removed, relatively moving the blank toward the axis of rotation of a rotary material-removing element during continuous rotation of the element such that the blank engages the rotating material-removing element at a predetermined operating point at the periphery of the rotating element and such that a given depth of material is removed at said edge portion of the blank, and moving one slide relative to the rotating material-removing element along a straight path while retaining the blank engaged at said predetermined operating point with said material-removing element to remove material to said given depth and thus to form a straight side portion on the blank, rotating the table when the operating point reaches an end of the blank to form a rounded corner, moving another slide as the table completes a rounded corner to form a further straight side of the blank, and continuing the alternate rotation of the table and rectilinear movement of the slides to progressively move the successive sides of the blank into engagement with the rotating material-removing element at said predetermined operating point to remove material to the desired depth on all sides of the blank, and repeating such alternate rotation and rectilinear movement at successive depths into the blank until the blank is formed with rectilinear sides and rounded corners of respective desired dimensions.

* * * * *